US005520118A

United States Patent [19]

McCarthy

[11] Patent Number: 5,520,118

[45] Date of Patent: May 28, 1996

[54] ADJUSTABLE END SUPPORT FOR A WIRE SHELF

[76] Inventor: Dennis J. McCarthy, 1601 W. North St., Springfield, Ohio 45502

[21] Appl. No.: 289,504

[22] Filed: Aug. 12, 1994

[51] Int. Cl.[6] ..... A47B 5/00

[52] U.S. Cl. ..... 108/42; 108/152; 211/90; 211/175

[58] Field of Search ..... 108/42, 65, 185, 108/152, 108, 137, 102; 211/90, 106, 175; 248/250

[56] References Cited

U.S. PATENT DOCUMENTS

| | | | |
|---|---|---|---|
| 3,419,155 | 12/1968 | Black et al. | 211/90 |
| 3,598,064 | 8/1971 | Stempel | 108/42 X |
| 4,178,844 | 12/1979 | Ward et al. | 108/102 X |
| 4,318,487 | 3/1982 | McCarthy | 108/42 X |
| 4,361,099 | 11/1982 | Kokenge et al. | 108/152 |
| 4,553,523 | 11/1985 | Stohrer, Jr. | 211/175 X |
| 5,178,287 | 11/1993 | Klein et al. | 211/106 X |
| 5,325,973 | 7/1994 | Reedy | 211/90 X |

*Primary Examiner*—Peter M. Cuomo
*Assistant Examiner*—Janet M. Wilkens
*Attorney, Agent, or Firm*—Joseph G. Nauman

[57] ABSTRACT

An end bracket is provided which can be infinitely adjustably fitted (within a given range) to a novel modular coated wire shelf, having tubular front rails, to compensate for slight deviations in closet wall spacing widths. The end bracket attaches telescopically to the tubular upper and lower front shelf rails, and is locked in position so movement of the rails relative to the bracket is prevented once the bracket is seated against one of the side walls between which the shelf extends. The bracket includes rods which can fit into holes provided in the walls to form the necessary support for the front of the shelf.

3 Claims, 2 Drawing Sheets

ADJUSTABLE END SUPPORT FOR A WIRE SHELF

BACKGROUND OF THE INVENTION

1. Field of the Invention

The present invention relates to adjustable end brackets for shelves, and more particularly to end brackets which are used with modular coated wire shelves.

2. Prior Art

Shelves made of spaced wire rods coated with plastic are becoming increasingly popular both to promote air circulation about and through the items and thus reduce the likelihood of mildew damage, and also because they lend themselves to "do-it-yourself" installation. Many such shelf items are now available in building supply supermarkets open to the general public. Typically, these shelves include vertically spaced upper and lower front rails, a back rail, and a plurality of stringers which extend between the back rail and the upper front rail, and are evenly spaced along the length of the rails, but leaving exposed or extended ends of the rails beyond the last of the stringers. In some such shelves, some or all of the stringers may extend around the front upper rail and down to the front lower rail. The shelves are modular and are sized to fit within a standard size closet, or between walls of a standard or modular spacing.

There are a number of means for mounting a modular coated wire shelf in a closet. For example, U.S. Pat. No. 3,598,064 discloses a modular coated wire shelf having front and rear wall mounting brackets. The front wall mounting bracket, or end bracket, is secured to a wall by a screw and a wall anchor, if necessary, and includes a U-shaped channel shaped to receive the upper and lower rails. In one embodiment, a spacer is positioned between the upper and lower rails in the U-shaped channel to prevent the weight of the load resting on the stringers from deflecting the upper rail toward the lower rail.

An improved end bracket for such shelves is disclosed in U.S. Pat. No. 4,318,487. Such bracket provides a stepwise adjustment relative to the wires of the shelf, to accommodate sidewall spacing somewhat greater than the shelf width. The available adjustment, however, depends upon the spacing between successive ribs in the bracket, which define a series of slots. The slots cannot be less than the wire thickness, so that an infinite type of adjustment is not possible.

SUMMARY OF THE INVENTION

The present invention provides a simplified and improved end bracket for modular wire coated shelves in which the end bracket is adjustable relative to the shelf so the shelf can accommodate the spacing between closet walls (or the like) which deviate from standard widths. By proper adjustment of the end brackets, the end brackets and front upper and lower rails are combined to form a rigid connection that is closely fitted between opposed walls. The brackets and shelves can be installed rapidly, yet firmly, so they will not work free from the closet walls as a result of repeated variations in shelf loads. The front rails of the shelf are either tubular throughout their length, or have tubular ends of predetermined length. A convenient arrangement can be achieved by constructing the shelf front rails of appropriate tubular material instead of the commonly used solid rod. The improved end brackets include complementary upper and lower auxiliary rail parts which slide into the tubular portions of the shelf front rails, and effectively become an extension (or extensions) of the front rails of the shelf, which extension is firmly pressed into engagement with the adjacent wall.

The end bracket of the present invention comprises the aforementioned upper and lower auxiliary rails, joined by a cross member near one end of such rails, leaving a short section of rail to be received in holes or sockets formed in the adjacent wall structure. Typically the auxiliary rails of the bracket will be in the order of nine (9) inches in length, and the cross member will be fastened to those rails about 1 inch from their outer ends, that is, the ends to be engaged with the supporting walls at the sides of the shelf.

The shelf is installed by attaching its rear rail to the back wall of the closet space with conventional brackets, then holes are formed (drilled) into the side walls spaced vertically according to the spacing of the bracket auxiliary rails and just large enough in diameter to fit the rails snugly into the holes. These holes are, of course, a an appropriate level with respect to the back rail so as to mount the shelf level. The bracket auxiliary rails are moved into the tubular front upper and lower shelf rails, the shelf front is located to align the short outer parts of the auxiliary rails with the holes or sockets formed in the walls, then the brackets are pushed outward to insert the ends of the auxiliary rails fully into those holes, until the bracket cross member abuts the wall surface. A single screw or nail through the cross member into the wall can be used to firmly seat the cross member against the wall surface. Finally, an appropriate length of longitudinally split tubing is cut to length, to fit snugly between the bracket cross member and the first (outer) stringer of the shelf, surrounding the upper bracket auxiliary rail and the upper front shelf rail outwardly from where the two are telescoped together.

Accordingly, it is an object of this invention to provide an end bracket which can be infinitely adjustably fitted (within a given range) to a modular coated wire shelf, to compensate for slight deviations in closet wall spacing widths; to provide an end bracket which attaches telescopically to the upper and lower front shelf rails, and locked in position so movement of the rails relative to the bracket is prevented; and to provide modular coated wire shelves in which the shelf front rails are tubular, and end brackets which have rods that attach telescopically to the upper and lower front rails.

Other objects and advantages of the invention will be apparent from the following description, the accompanying drawings and the appended claims.

DESCRIPTION OF THE PREFERRED EMBODIMENT

Figure 1:
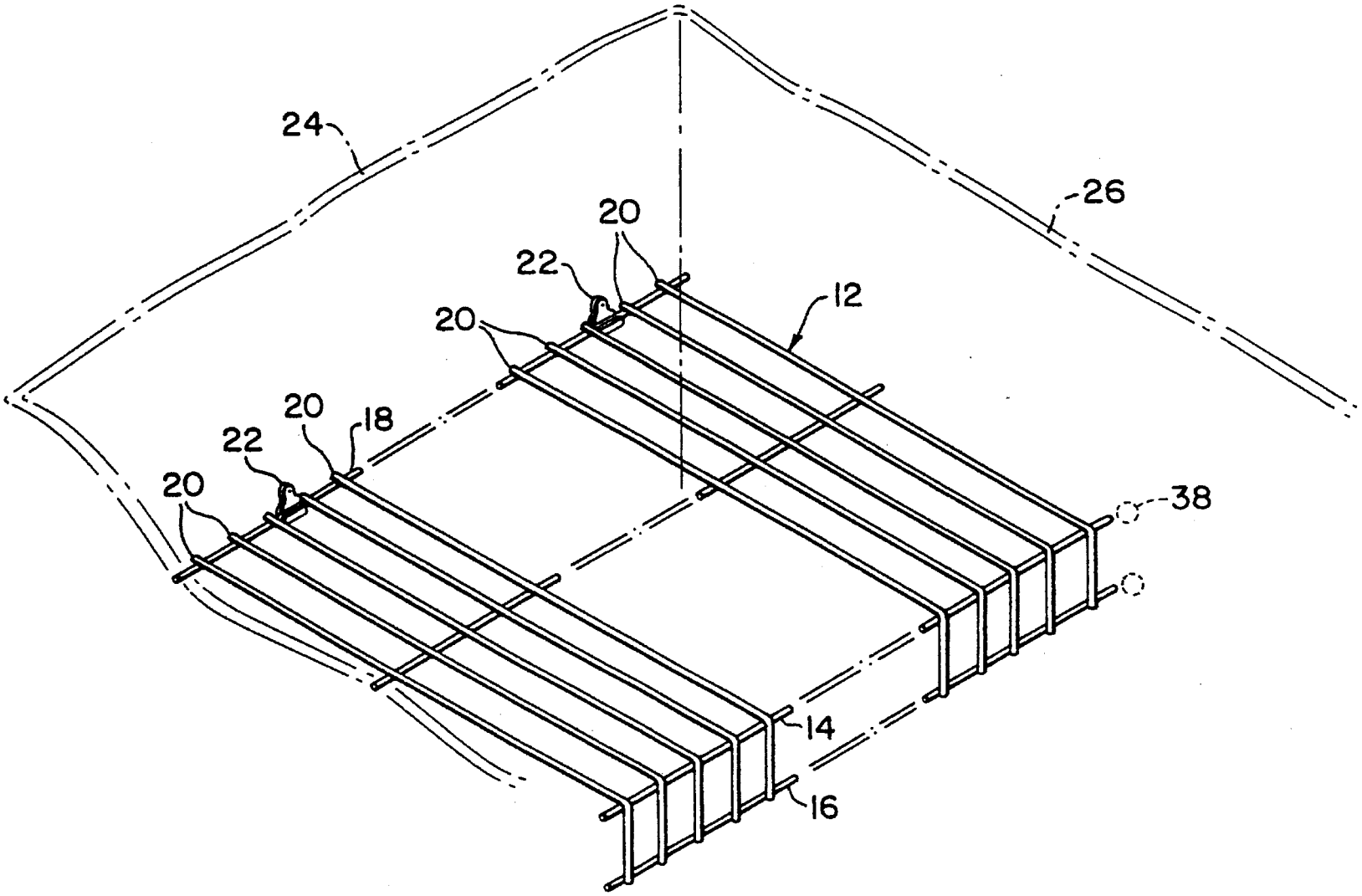
FIG. 1 is an exploded perspective view of one end of a typical wire shelf to which the present invention pertains.

As shown in FIG. 1, adjustable end brackets 10 of the present invention are used to support a modular coated wire shelf 12 having an upper front rail 14, lower front rail 16, back rail 18, and a plurality of stringers 20 extending from the back rail to the upper front rail around the upper front rail 14 to the lower front rail 16. Shelves 12 in which the stringers 20 extend from the back rail 18 only to front rail 14 also can be used with the end bracket 10 (see FIG. 2) for an example; there, the front rail are attached by separate struts, or may be attached by extending a few of the stringers. The back rail 18 is supported by clips 22 which are attached to the rear wall 24 of a closet or other enclosure by means of a screw and wall anchor (not shown) in a manner known in the art. The end brackets 10 each engage an end of the upper front rail 14 and lower front rail 16 and are fitted to a side wall 26 of the enclosure. Front rails 14, 16 are either made of tubular material, or are provided with tubular ends, such that each rail may receive a part of end brackets 10, as explained below.

Figure 2:
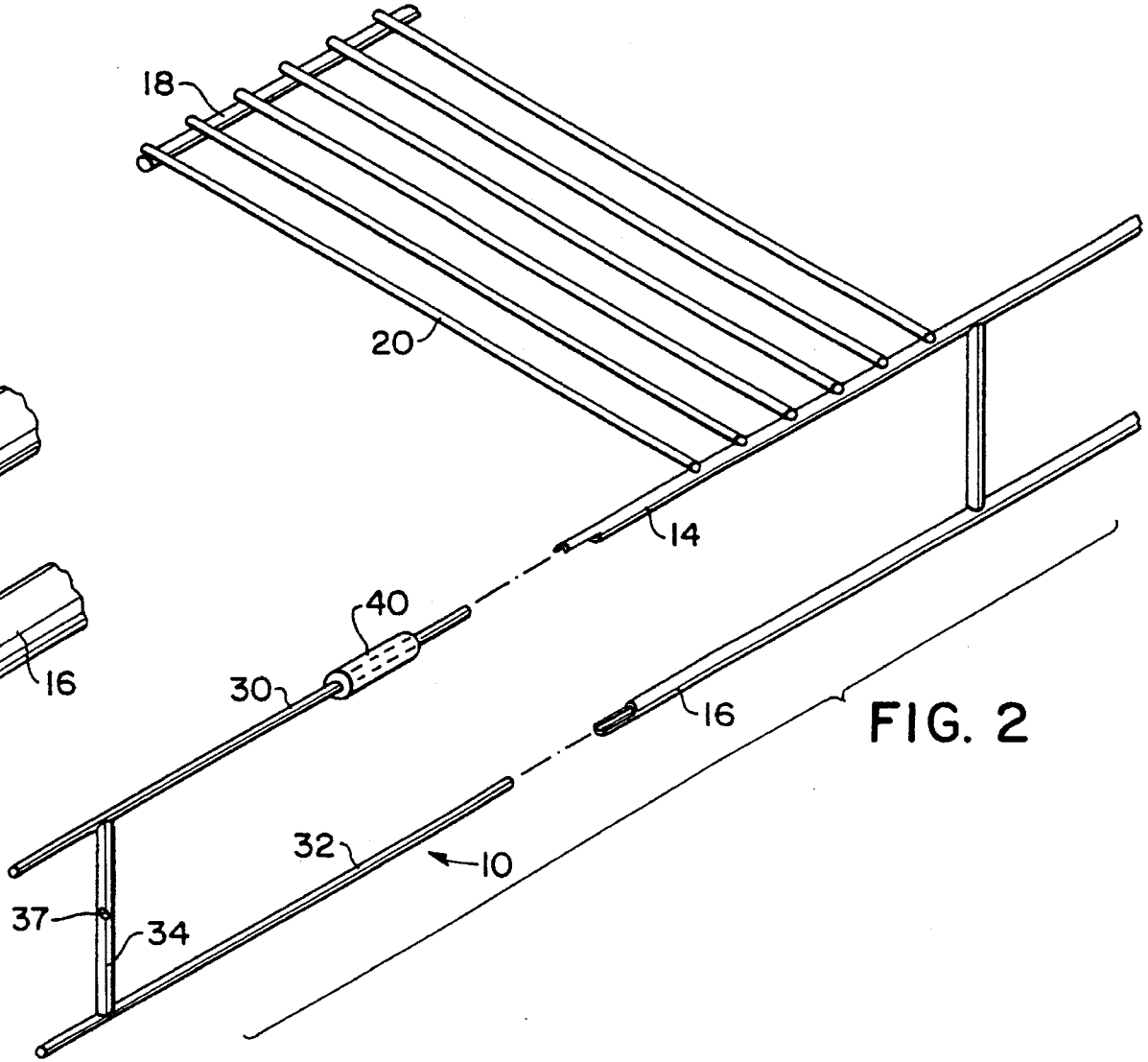
FIG. 2 is an enlarged perspective view showing a form of infinitely adjustable end bracket for supporting the shelf, according to the present invention.
Figure 3:
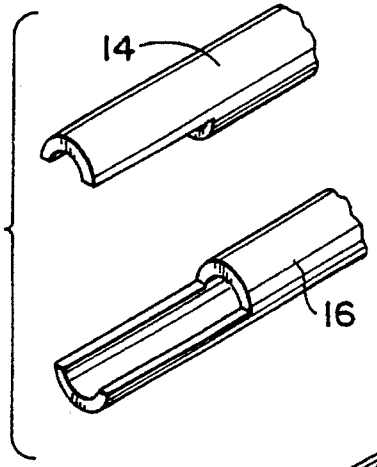
FIG. 3 is a further enlarged view of the end of the front shelf rails, showing their tubular configuration for accommodating the adjustable end bracket.

The end bracket 10 of the preferred embodiment is shown more clearly in FIG. 2, and comprises a pair of auxiliary upper and lower rails or bracket rods 30 and 32, fastened to a cross member 34. The cross member 34 is located near one end of rods 30, 32, and preferably has an aperture 37 to receive a fastener (screw or nail). In a typical construction, rods 30, 32 are in the order of nine inches long, and extend about one inch past cross member 34.

The interaction of the preferred end bracket 10 and shelf 12 for installation within an enclosure is best shown in FIG. 2. The shelf is installed by attaching its rear rail 18 to the back wall 24 of the closet space with conventional brackets or clips 22, then holes 38 are formed (drilled) into the side Walls 26 spaced vertically according to the spacing of the bracket auxiliary rails 30, 32 and just large enough in diameter to fit the rails snugly into the holes. These holes are, of course, at an appropriate level with respect to the back rail so as to mount the shelf level. The holes can, if desired, be reinforced by a suitable tubular insert (not shown).

The bracket rods 30, 32 are moved into the tubular front upper and lower shelf rails 14, 16, the shelf front is located to align the short outer parts of the rods 30, 32 with the holes 38 or sockets formed in the walls, then the brackets are pushed outward to insert the ends of the rods fully into those holes, until the bracket cross member abuts the wall surface. A single screw or nail (not shown) extending through the cross member aperture 37 into the wall can be used to firmly seat cross member 34 against the wall surface.

Finally, an appropriate length of longitudinally split tubing 40 is cut to length to fit snugly between bracket cross member 34 and the first (outer) stringer of the shelf, surrounding the upper bracket rod 30 and the upper front shelf rail 14 outwardly from where the two are telescoped together. Such tubing can be used on both upper and lower front members if desired.

While the forms of apparatus herein described constitute preferred embodiments of this invention, it is to be understood that the invention is not limited to these precise forms of apparatus, and that changes may be made therein without departing from the scope of the invention.

What is claimed is:

1. A wire shelf adapted to traverse a space between two opposed wall surfaces, as in a closet, the shelf including a front having spaced apart upper and lower horizontal front rods attached to each other by spacer members, a rear having at least one horizontal rear rod, and a top formed of load bearing rods fixed at their opposite ends to said rear rod and one of said front rods, said front rods having free portions at their ends outward of the spacer members; the improvement comprising a front corner end support including a vertically disposed member adapted to abut one of the wall surfaces between which said shelf extends, a pair of parallel bracket rods attached to and extending from said vertically disposed member, said bracket rods having first free ends on one side of said vertically disposed member and adapted to engage into apertures in the adjacent wall surface, said bracket rods having second free ends adapted to interlock with said front rods of said shelf, at least one of said second free ends of said bracket rods being in telescopic engagement with one of said shelf front rod ends to provide support for the front of the shelf and to accommodate variations in spacing of said free portions of said front rod ends from the adjacent wall surfaces, said upper and lower front rods of said shelf being formed at their free ends of tubular configuration of a size to receive, in a close fit, said second free ends of said bracket rods.

2. A width adjustable wire shelf adapted to traverse a space between two opposed walls, said shelf including a front having spaced apart upper and lower horizontal tubular front rods attached to each other by spacer members, a rear having at least one horizontal rear rod, and a top formed of load bearing rods fixed at their opposite ends to said rear rod and one of said front rods, said tubular front rods having free portions at their ends outward of the spacer members;

at least one front corner end support for said shelf, said end support including a vertically disposed member adapted to abut one of said wall surfaces between which said shelf extends, a pair of parallel bracket rods on said end support spaced apart corresponding to the spacing of said tubular front rods, said bracket rods being attached to and extending from said vertically disposed member, said bracket rods having first free ends on one side of said vertically disposed member and adapted to engage into apertures in the wall surface, said bracket rods having second free ends adapted to interlock with said front rods of the shelf, said second free ends of said bracket rods having a diameter which permits sliding interfit of said second free ends into said tubular ends of said upper and lower shelf front rods for telescopic engagement of said corner end support with said shelf front rod ends to provide support for the front of the shelf and to accommodate variations in spacing of the front rod ends from the adjacent wall surfaces.

3. A wire shelf as defined in claim 2, wherein said vertically disposed bracket member includes an aperture therethrough for accommodating fasteners to hold said vertically disposed member against one of the wall surfaces.

* * * * *